US010343830B2

(12) United States Patent
Frischmann et al.

(10) Patent No.: US 10,343,830 B2
(45) Date of Patent: Jul. 9, 2019

(54) OUTER PACKAGING FOR BLISTER PACKAGING

(71) Applicant: Constantia Pirk GmbH & Co. KG, Pirk (DE)

(72) Inventors: Stefan Frischmann, Vohenstrauss (DE); Florian Frischholz, Moosbach (DE); Wolfgang Krauss, Kohlberg (DE)

(73) Assignee: Constantia Pirk GmbH & Co. KG, Pirk (DE)

( * ) Notice: Subject to any disclaimer, the term of this patent is extended or adjusted under 35 U.S.C. 154(b) by 0 days.

(21) Appl. No.: 15/770,044

(22) PCT Filed: Aug. 18, 2016

(86) PCT No.: PCT/EP2016/069626
§ 371 (c)(1),
(2) Date: Apr. 20, 2018

(87) PCT Pub. No.: WO2017/067691
PCT Pub. Date: Apr. 7, 2017

(65) Prior Publication Data

US 2018/0312316 A1 Nov. 1, 2018

(30) Foreign Application Priority Data

Oct. 20, 2015 (AT) ..... 50894/2015

(51) Int. Cl.
*B65D 75/36* (2006.01)
*B65D 75/32* (2006.01)
(Continued)

(52) U.S. Cl.
CPC ..... *B65D 75/367* (2013.01); *B65D 75/327* (2013.01); *B65D 77/0406* (2013.01); *B65D 83/0463* (2013.01); *B65D 2215/04* (2013.01)

(58) Field of Classification Search
CPC .. B65D 75/002; B65D 75/006; B65D 75/367; B65D 75/327; B65D 77/0406; B65D 83/0463; B65D 75/30; B65D 75/38
(Continued)

(56) References Cited

U.S. PATENT DOCUMENTS 5,150,793 A 9/1992 Tannenbaum
6,997,320 B1 * 2/2006 Kancsar ..... B65D 75/327 206/532

(Continued)

FOREIGN PATENT DOCUMENTS

DE 60202458 T2 6/2005
DE 102009042858 A1 4/2011

(Continued)

OTHER PUBLICATIONS

Austria Search Report Application No. A 50894/2015 Completed Date: Apr. 27, 2016 1 page.

(Continued)

*Primary Examiner* — Anthony D Stashick
*Assistant Examiner* — L E Kmet
(74) *Attorney, Agent, or Firm* — Whitmyer IP Group LLC

(57) ABSTRACT

The present teaching relates to a packaging unit for one or more individually removable products, in particular tablets, including a blister packaging and a bag-type outer packaging, in which the blister packaging is enclosed. The blister packaging is movably arranged in the outer packaging and can be brought into at least one removal position, in which the removal of at least one of the products is enabled. The blister packaging has at least one positioning element, and the outer packaging has at least one receiving element for the positioning element, wherein the positioning element arranged in the receiving element defines the removal position.

20 Claims, 5 Drawing Sheets

(51) Int. Cl.
*B65D 77/04* (2006.01)
*B65D 83/04* (2006.01)

(58) Field of Classification Search
USPC ..... 206/497, 531
See application file for complete search history.

(56) References Cited

U.S. PATENT DOCUMENTS

| | | | | |
|---|---|---|---|---|
| 8,162,141 | B2 * | 4/2012 | Baker | B65D 75/36 206/461 |
| 2002/0153276 | A1 | 10/2002 | Filion et al. | |

FOREIGN PATENT DOCUMENTS

| | | | |
|---|---|---|---|
| EP | 1057750 | A1 | 12/2000 |
| WO | 2004052749 | A1 | 6/2004 |
| WO | 2007030067 | A1 | 3/2007 |

OTHER PUBLICATIONS

International Search Report and Written Opinion of the International Search Authority Application No. PCT/EP2016/069626 Completed Date: Oct. 26, 2016; dated Nov. 7, 2016 9 pages.

* cited by examiner

OUTER PACKAGING FOR BLISTER PACKAGING

TECHNICAL FIELD

The present teaching relates to a packaging unit for one or a plurality of individually removable products, specifically tablets, wherein the packaging unit has a blister packaging and a bag-type outer packaging, in which the blister packaging is enclosed.

BACKGROUND

Blister packagings have become a widespread standard because of their cost-efficient manufacturing, their hygienic and air-tight properties and their ease of use, particularly for packaging pharmaceutical products such as tablets or coated tablets or nutritional supplements in many areas of use.

The ease of use, however, also permits small children to remove the tablets from the blister packaging, which leads to problems with respect to child safety, as children could confuse the medications with sweets. This problem is compounded by the fact that medicines for adults are also increasingly mixed with flavorings in order to make taking them easier to administer and to improve their acceptance.

Blister packagings are usually provided for distribution with an outer packaging, wherein outer packaging in the form of a bag is used in addition to the customarily known cardboard box. Bag packaging offers, among others, advantages in manufacturing because they can be printed in-line, for example, while carton packaging, by contrast, must be newly produced with every change in the print.

Countless solutions have been developed to make it harder for children to access the tablets packaged in the blister packagings. For example, WO007030067 A1 discloses a housing as an outer packaging for a blister packaging that only allows the removal of a tablet from the blister packaging if the blister packaging has previously been pushed from a safety position into a removal position. In this arrangement, the blister packaging is held in the safety position by an actuating mechanism. Only after releasing the actuating mechanism is it possible to push the blister packaging into the removal position.

Even if this solution offers a high measure of safety, it has some drawbacks. The housing is a relatively complex and expensive product that is individually adapted to just one specific tablet and packaging size. As a one-use item, the outer housing is very expensive. If the outer packaging is provided for multiple uses, after removing the last tablet, the user is himself responsible for placing a new, full blister packaging in the outer packaging and thereby securing it.

It is to be expected that many consumers would not comply with these safeguards and would remove the tablets directly from the blister packaging in the usual manner.

DE 10 2009 042858 A1 discloses an outer packaging for blister packagings, wherein the outer packaging protects the blister packaging against an inadvertent removal by children. The outer packaging is designed as a carton and is made of a plurality of layers in some cases designed to be elastic, wherein openings are made in at least one layer. The blister packaging is displaceably arranged in the outer packaging and a removal of the medication from the blister packaging is only possible if the openings of the blister are in alignment with the openings in the layer.

U.S. Pat. No. 5,150,793 discloses a device for preventing an inadvertent discharge from a blister packaging, wherein the blister packaging is displaceably arranged in a housing and can be moved over corresponding openings in the housing for removal. The housing can be made from plastic, cardboard or composite materials.

SUMMARY

The present teaching is based on the object of creating a simple, cost-efficient and easily manufactured child-proof lock for blister packagings that are packed in bag-type outer packaging.

According to the present teaching, this goal is achieved by a packaging unit of the aforementioned type, in which the blister packaging is movably arranged in the outer packaging and can be brought into at least one removal position in which the removal of at least one of the products is possible, wherein the blister packaging has at least one positioning element and the outer packaging or a locking element arranged in or at the outer packaging has at least one receiving element for the positioning element, and wherein the positioning element arranged at the receiving element defines the removal position. Such a packaging is made exclusively of disposable materials, wherein the safety characteristics can be simply and inexpensively incorporated in the outer packaging or the blister packaging. The production can, in most cases, be accomplished using the same machine that is already used for packaging the products in the blister packaging and for packaging the blister packaging in the outer packaging.

In a preferred embodiment, at least one cup-like cavity of the blister packaging can form a positioning element. This permits the implementation of the idea according to the present teaching without having to alter the standard form of the blister packaging.

The at least one cup-like cavity or the plurality of cup-like cavities that here forms the positioning element can, in another advantageous embodiment, be free of product. This is then advantageous, for example, if the cup-like cavity can be damaged or deformed during positioning in the receiving element, or if this deformation is required to secure the cup-like cavity in the receiving element.

In an advantageous embodiment of the present teaching, at least one positioning element can be formed by an extension of the molded part of the blister packaging. The extension of the molded part of the blister packaging, for example laterally beyond the region in which the cup-like cavities containing the products are arranged, makes it possible, for example, to give the extension a shape that fits in a positive locking manner into the corresponding receiving element. A "key-lock" system can be realized that enables a precise positioning of the blister packaging in the removal position. In addition, the receiving element can be protected using additional means against its assuming an unacceptable position.

In another embodiment of the present teaching, at least one receiving element can be defined by a molding in the outer packaging. Such a molding is easy to produce and easy to use.

This molding can be designed in an advantageous manner for receiving a cup-like cavity of the blister packaging. In this manner it is easy for the user to recognize how the blister packaging is to be arranged, and it is also easy to check whether the blister packaging or its positioning element is correctly arranged in the receiving means.

The molding can, in an additional advantageous embodiment, form a receiving recess in the edge region of the outer packaging. This can be easily produced, such as in the form of a welding or adhesive zone on the edge region of the outer packaging.

In an advantageous manner, the receiving element can be activated and/or deactivated by a user intervention. For example, the opening of a molding acting as a receiving element can initially be sealed by a dividing element that must first be punctured by active application of force at the proper position in order to enable an arrangement of the positioning element in the receiving element. On the other hand, an edge region of the outer packaging, in which the receiving element is located could also be designed to be folded, so that the openings of the receiving element must first be freed by folding the edge region before the positioning element is inserted in the receiving element, or it can be closed again by folding it back. It can also be required to have to remove safety elements, such as stickers or parts of the outer packaging, in order to activate the receiving element.

In a further advantageous embodiment, at least one receiving element can be defined by a weak point in a first bag film and/or a second bag film of the outer packaging. A weak point—such as a thinning of the material or a perforation—can be introduced into the film material very easily, wherein the weak point can be introduced into the bag film on the side of the cup-like cavities (which are here described as the first bag film), so that the first bag film can be punctured in the region of the weak point using a cup-shaped cavity provided as a positioning element or an extension of the blister packaging. The weak point can also be introduced into the film material facing the rear wall of the blister packaging (which is described herein as the second bag film). For example, a part of the bag film defined by the weak point can be pressed into a cup-like cavity provided as a positioning element in order to secure the blister packaging in the removal position. The weak point may also be designed as an elastic or plastically expansible region or it may include materials or elements that are not a component of the actual bag film.

In a further advantageous embodiment, the weak point can be arranged in such a manner that at least one cup-like cavity of the blister packaging breaks open the weak point when the blister packaging is moved into the removal position. This permits an especially easy handling, in particular if the breaking open is accomplished automatically if the blister packaging is brought into the removal position using sufficient force.

In an advantageous manner, the breaking open of the weak point can require a movement of the blister packaging along the rear-wall level of the blister packaging. Here, for example, a part of the blister packaging, in which the weak point(s) is (are) also located, can be displaced into a receiving recess arranged in an edge region of the outer packaging. If the inner height of the receiving recess is too low to accommodate the cup-like cavities, the film material of the outer packaging in this region is displaced upward by the cup-like cavity, wherein the weak points break open. Simultaneously, the cup-like cavity or cavities can be secured in the removal position.

In a further advantageous embodiment, at least one product chamber of the blister packaging can be arranged having the product-dispensing side above a break-through point provided in the second bag film of the outer packaging in the removal position. The break-through point allows the product contained in the product chamber, or the tablets contained therein, to be pressed through the rear wall of the blister packaging and through the break-through point of the second bag film and removed. The break-through point can, for example, be designed as a round, slot-like or cross-slot-like weakness of the film material.

Break-through points and weak points can be introduced into the bag material in a known manner by mechanical incising or die-cutting the bag material (corresponding to a method that is also known in the field as a "kiss cut") or using a laser. Where applicable, the break-through characteristics of the bag material can be additionally improved, for example, by the use of appropriate filler materials that are added to the material and are known in the field. Talcum, silica or chalk are counted among the filler materials with which the bag material can be filled or underfilled.

In a further advantageous embodiment, a plurality of different removal positions can be provided in the outer packaging. In this manner, it is possible to prescribe dosing regimens for the medication administration sequence. Using the already recognizable receiving element or positioning element employed, the user can identify which part of the dosage he has already taken (e.g. Monday, Tuesday, Wednesday, etc.), wherein dosing errors can be prevented or at least recognized.

In a further advantageous embodiment, a locking element that has at least one receiving element for the positioning element can be integrated into the outer packaging, arranged therein or connected to it. This expands the choice of safety measures according to the present teaching. Furthermore, the locking element can ensure an additional packaging stability.

BRIEF DESCRIPTION OF THE DRAWINGS

The present teaching is explained below with reference to FIGS. 1 to 11, showing exemplary, schematic and non-restrictive advantageous embodiments of the present teaching. Shown are

DETAILED DESCRIPTION

Figure 1:
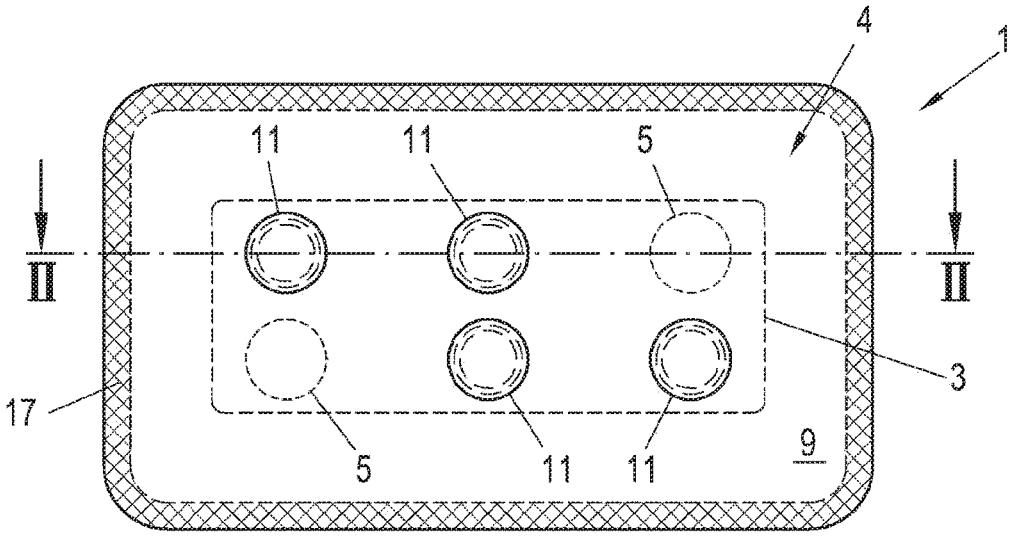
FIG. 1 is a packaging unit according to the present teaching in a bottom view.
Figure 2:
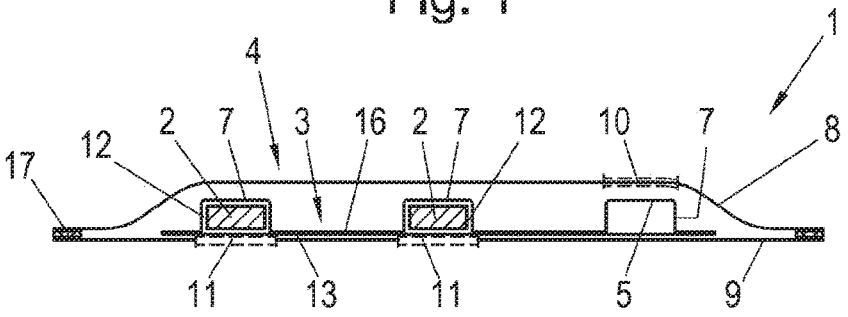
FIG. 2 is the packaging unit according to the present teaching from FIG. 1 in a sectional view transverse to the blister packaging along the line II-II, which is represented in FIGS. 1 and 3.
Figure 3:
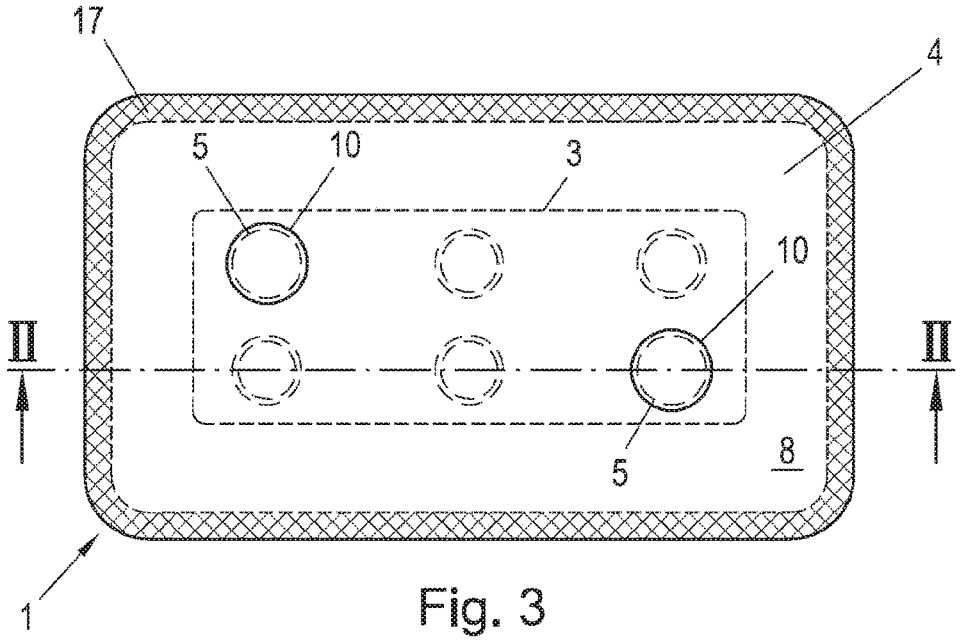
FIG. 3 is the packaging unit according to the present teaching from FIG. 1 in a top view.

FIGS. 1 to 3 show a first embodiment of the packaging unit 1 according to the present teaching in three views. The packaging unit 1 comprises a blister packaging 3 that is, in turn, packed within an outer packaging 4. The blister packaging 3 comprises a molded part 16, into which a plurality of cup-like cavities 7 are introduced in a known manner. In the sectional view in FIG. 2, three cup-like cavities 7 are represented that each define a product chamber 12, in each of which a product 2 is located. The molded part 7 is covered in a known manner by a back wall 13, which is generally made from an aluminum, paper or plastic film and which is punctured during the removal of a product from the blister packaging. As depicted in FIGS. 1 and 3, the exemplary blister packaging 3 has six product chambers 12, wherein products 2 are located in only four of these product chambers, however, and the other two product chambers 12 are empty. As is discussed in more detail below, the two empty product chambers 12 serve as positioning elements 5.

The products 2 are generally medicines, mostly in tablet form; however, other single-piece products can also be packaged using the packaging unit according to the present teaching, such as household items like cleaning tablets, fertilizer tablets or insecticides, or some other sort of product that should be kept out of the reach of children.

The outer packaging 4 essentially comprises a first (outer) bag film 8 and a second (inner) bag film 9 that are connected together at their edge by a seal region 17. This embodiment is described purely by way of example because, essentially, different types of bag-like outer packagings can be used depending upon the application. The difference between first bag film 8 and second bag film 9 serves only for ease of reference and description and can be similar or different films. In connection with the representational description, the film that is located above the blister packaging 3, meaning located on the side of the cup-like cavities 7, is described as first or upper bag film 8 and, correspondingly, the film that is located below the blister packaging 3, meaning on the side of the back wall 13, is described as second or lower bag film 9.

As can be seen, in particular, from FIGS. 1 and 3, the outer packaging 4 is dimensioned substantially larger than the size of the blister packaging 3 would require. In this manner, the blister packaging can essentially move and twist freely horizontally within the boundaries of the outer packaging 4, wherein the size is preferably measured so that a "rotation" of the blister packaging within the outer packaging 4 into a position in which the cup-like cavities 7 would face the second, inner bag film 9 is not possible.

On the second bag film 9 (see FIG. 1), a plurality of break-through points 11 are arranged, wherein the arrangement of the break-through points 11 corresponds to the arrangement of the product chambers 12 of the blister packaging 3 that are filled with a product 2. Only if a product chamber 12 is arranged precisely above a break-through point 11 can the product 2 located in this product chamber 12 be removed by the corresponding cup-like cavity 7 being pressed in a known manner so that the product 2 is pushed out through the back wall 13, which breaks at this point, and by the also-breaking break-through point 11 and can be pushed out and removed. The position in which the product chambers 12 containing the products 2 are aligned with break-through points 11 is designated herein as "removal position".

Because the blister packaging 3 can move within the outer packaging 4, the product chambers, in general, are, however, not aligned with the break-through points 11, or the blister packaging 3 is not located in its removal position. In another position, however, it is not possible to press the product through the back wall 13 and the second bag film 9 because, without break-through point 11, this offers too great a resistance.

The break-through points 11 can be designed as weak points or perforations and they can, as represented in FIG. 1, correspond to the, in this case round, shape of the product 2; however, they can also have a different shape, or be arranged as slit shapes, cross shapes or, for example, be u-shaped. In general, the break-through points 11 each have a desired shape that allows the products 2 to be pressed through.

In order to offer the user the possibility of bringing the blister packaging 3—which, because of the flexibility of the bag films, can be moved and displaced inside the outer packaging 4 even if the outer packaging 4 is sealed—into the removal position and to secure it there, the first bag film 8 has two weakened points 10. The weakened points can be designed in a manner similar to the break-through points 11 in second bag film 9; however, they are not used for the removal of products 2, but instead have a function as receiving elements 6 for the positioning elements 5. The user first moves the blister packaging 3 into the removal position, then the empty cup-like cavities 7 that serve as positioning elements 5 are pressed through the respective weakened points 10, whereby the latter are punctured so that they can act as receiving element 6 for the positioning element 5.

Alternatively, the weakened point 10 can also be designed to be elastically or plastically deformed so that first bag film 8 forms a molding in the region of the weakened point 10 if the positioning element 5 is pressed into the weakened point 10. As appropriate, instead of a weakened point 10, a pre-formed molding can be provided into which the positioning element 5 is inserted.

Figure 4A:
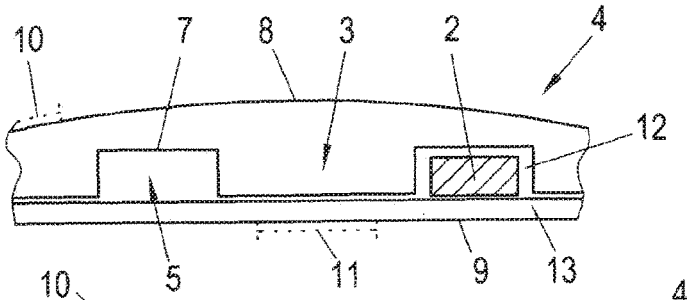
FIGS. 4*a*-4*d* are schematic representations of an exemplary sequence during the removal of a product.

In FIG. 4, the method for removing a product is schematically represented in individual steps:

FIG. 4*a*) shows a partial cross-section through the blister packaging 3, which is arranged in an outer packaging 4, wherein the product chamber 12, in which the product 2 is contained, is not located above the corresponding break-through point 11 that is indicated as a broken line. Even the empty cup-like cavity 7 that serves as positioning element 5 is not arranged under the weakened point 10. In such a position, it is not possible to press the product 2 through the back wall 13 and the second bag film 9.

Figure 4B:
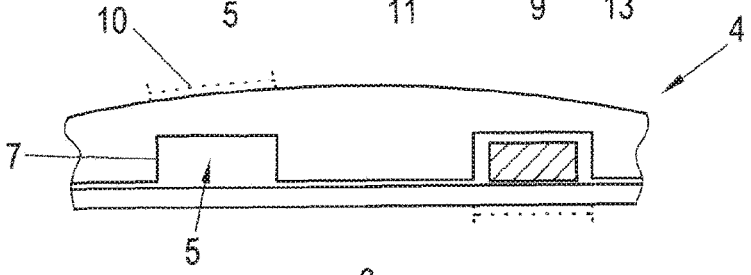
Figure 4C:
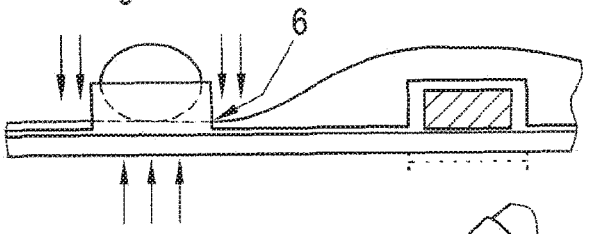

In the removal position of the blister packaging 3 described in FIG. 4*b*), the empty cup-like cavity 7 is arranged below the weakened point 10 and the product in the product chamber 12 is arranged above the break-through point 11, meaning the blister packaging 3 is located in the removal position.

In order to secure the blister packaging in the removal position, the empty cup-like cavity 7 is now pressed against the weakened point 10 (indicated by arrows) so strongly that it breaks through the weakened point 10 (FIG. 4*c*)), wherein the edge of the break-through forms the receiving element 6 for the positioning element 5 (in the case of the cup-like cavity 7).

If a second positioning element 5 is secured in a second receiving element (not shown in FIG. 4), the blister packaging can be secured against turning and held stably in its removal position.

Figure 4D:
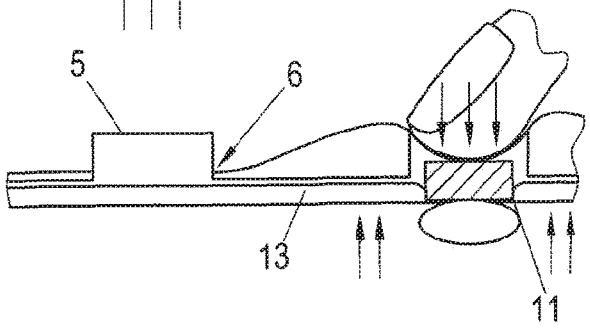

FIG. 4*d*) shows how the product 2 is pressed downward by a pressure on the cup-like cavity 7, in which the product 2 is located, down through the rear wall 13 and through the break-through point 11.

It is also possible to loosen the blister packaging 3 from the removal position after the removal of a first product 2 if the positioning element 5 is pressed out of the receiving element 6. The next removal of a product 2 can then be accomplished in turn only if the blister packaging 3 is again brought into the removal position.

Figure 5:
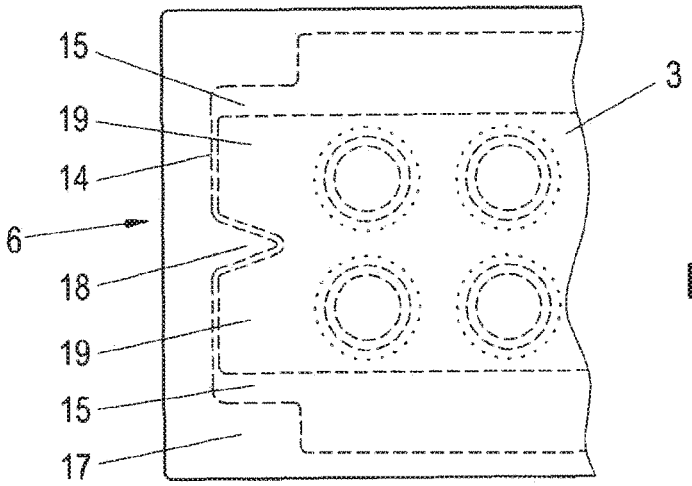
FIG. 5 is a schematic representation of a packaging unit according to a further embodiment.

FIG. 5 shows a further embodiment according to the present teaching, in which the receiving element 6 is designed as a molding 14 in the edge region of the outer packaging 4. The molding 14 can be defined by the course of the inner edge of the seal region 17, for example. The molding 14 described in FIG. 5 has two adjacent receiving recesses 15 that are separated from one another by a positioning wedge 18. As a positioning element, the molded part of the blister packaging 3 is extended on one end and there forms two extensions 19 that have a shape corresponding to the receiving recesses 15 of the molding 14. In FIG. 5, the molding 14 having the two receiving recesses 15 is made wider than the two extensions 19 of the blister packaging 3 so that the precise positioning of the blister packaging in the removal position is accomplished, specifically by the positioning wedge 18 that engages into the intermediate space between the two extensions 19. On the one hand, this simplifies the locating of the removal position and simultaneously provides a high child-resistance.

In addition, additional positioning elements 5 and receiving elements 6 can be provided, for example in the form previously referred to in FIGS. 1 to 4. In general, the features represented in the individual figures and described herein can be combined in a preferred manner by a person skilled in the art.

Figure 6:
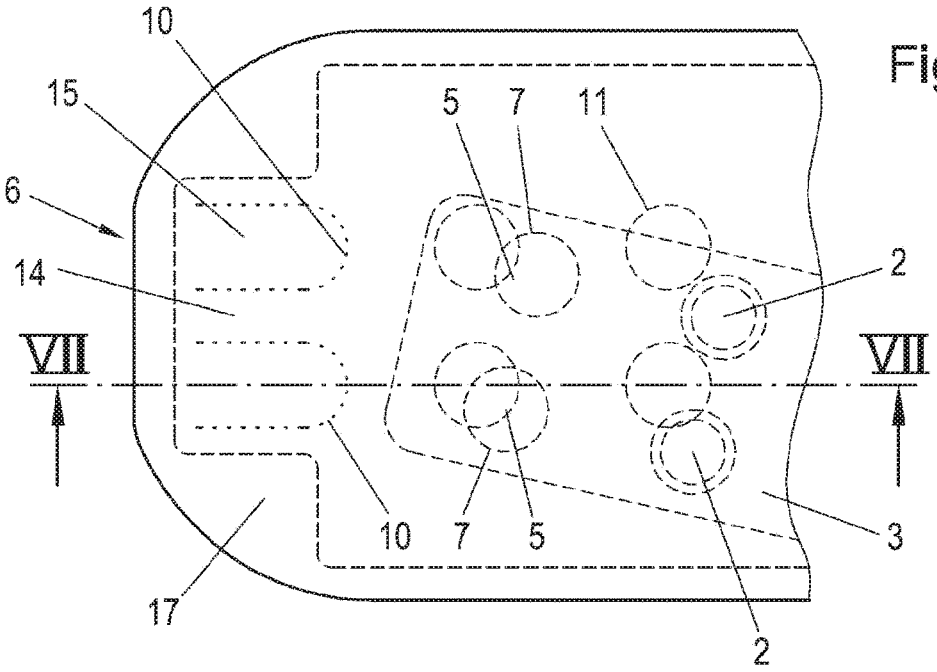
FIG. 6 is a schematic representation of a packaging unit according to a further embodiment.
Figure 7:
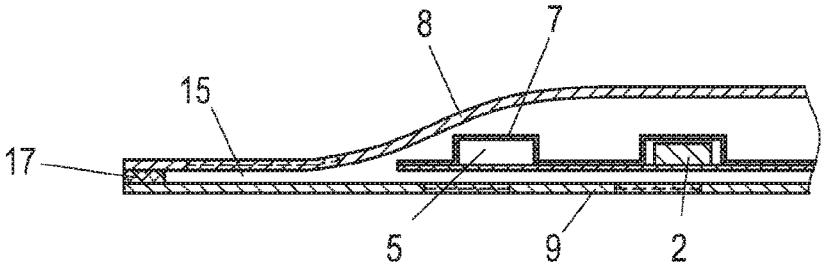
FIG. 7 is a sectional view of the embodiment shown in FIG. 6 along the line VII-VII in FIG. 6.

FIGS. 6 and 7 show a further advantageous embodiment that is also based on a receiving element 6 that is designed as molding 14 of the inner edge of the seal region 17 between the first bag film 8 and the second bag film 9. The molding 14 has an essentially U shape, the contour of which roughly corresponds to the shape of the edge at a narrow end of the blister packaging 3. In contrast to the embodiment in FIG. 5, however, the blister packaging has no extension, but has a common shape, wherein the outermost two cup-like cavities 7 (meaning the two cup-like cavities on the end of the blister packaging 3) are empty and serve as positioning elements 5.

As can be seen in cross-section in FIG. 7, the receiving recess 15 formed from the molding 14 has a height that is smaller than the height of the cup-like cavities 7 of the blister packaging 3 so that the narrow end of the blister packaging cannot be easily inserted into the receiving recess 15. This is necessary, however, in order to bring the blister packaging into the removal position that is defined by the break-through points 11 in the bag film 9.

The first bag film 8 has for this purpose two U-shaped weakened points 10 above the receiving recess 15 that are broken by the two empty cup-like cavities 7 serving as positioning element 5 if the blister packaging 3 is pushed with its end into the receiving recess with sufficient force. Simultaneously, the two positioning elements 5 are positioned by the U-shaped edges of the broken weakened point 10 in the removal position and secured.

According to the present teaching, the receiving elements—meaning, for example, the weakened points 10 in the embodiment of FIGS. 1 to 4 and 6 to 7 or receiving recesses 15 on the edge of outer packaging 4 in the embodiments of FIGS. 5 to 9 are protected against unauthorized use. For example, the weakened points 10 can be provided with removable reinforcements, such as in the form of stickers that must be pulled off or torn away before use.

Figure 8:
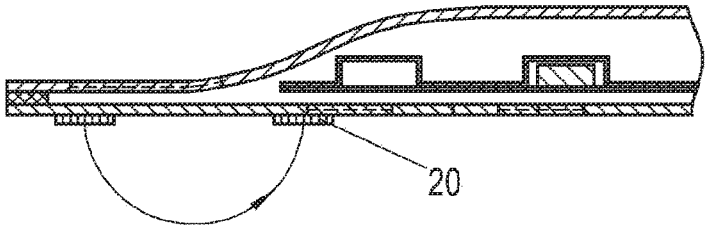
FIG. 8 is a schematic representation of a further advantageous embodiment of the present teaching.

The receiving recesses 15 can, for example, be protected by folding over so that it is no longer possible to insert the part of the blister packaging 3 provided for this into the receiving recess. In FIG. 8, such a safety form is illustrated as an example, wherein the whole edge region of the outer packaging 4 can be folded over downward. The edge region, for example, can be secured in the folded-over position by an adhesive region 20, wherein the adhesion system used can also enable a repeated releasing and re-sticking of the adhesive region 20.

Figure 9:
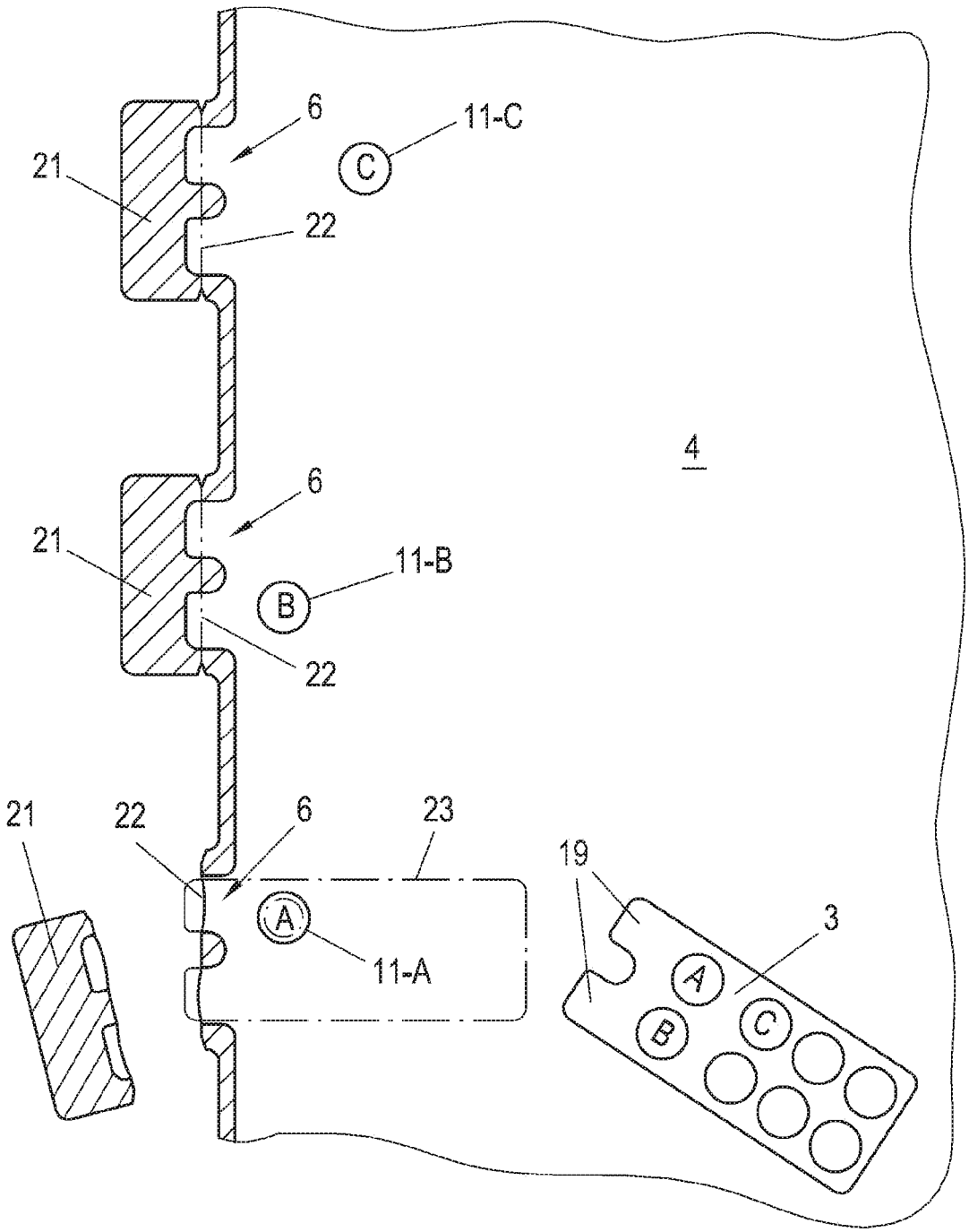
FIG. 9 is a schematic representation of a packaging unit according to a further embodiment.

A further advantageous embodiment is schematically represented in FIG. 9. The (exaggeratedly large) outer packaging 4 illustrated has on its edge a plurality of receiving elements 6 that have a shallow depth, however, so that they cannot receive the extensions 19 of the blister packaging 3. In order to "activate" the receiving elements 6, a tear tab 21 along a line of weakness 22 must first be removed, for example, by cutting off or tearing off, wherein the lines of weakness release the receiving elements 6. The extensions 19 can then be inserted into the receiving elements 6 opening outward, as is represented by the removal position 23 of the blister packaging 3 marked by a dashed line. The extensions 19 can thus be firmly grasped by the user to remove a product 2 in order to secure the blister packaging 3 in the removal position 23 during the removal process.

The removal position 23 can, for example, provide break-through points 11 for all products 2 contained in the blister packaging 3; it is, however, also possible to define a plurality of removal positions 23 that each permit only one removal of a single product 2 (or a defined quantity of precisely defined products 2) from a specific product chamber 12. In FIG. 9, for example, three receiving elements 6 are arranged that each enable removal positions 23 having a specified break-through point 11-A, 11-B, 11-C for a specific product 2. The user can tell by the already pulled-off tab which tablets have already been taken. Such an embodiment can be used for medications, for example, that must be taken in a specified order.

Figure 10:
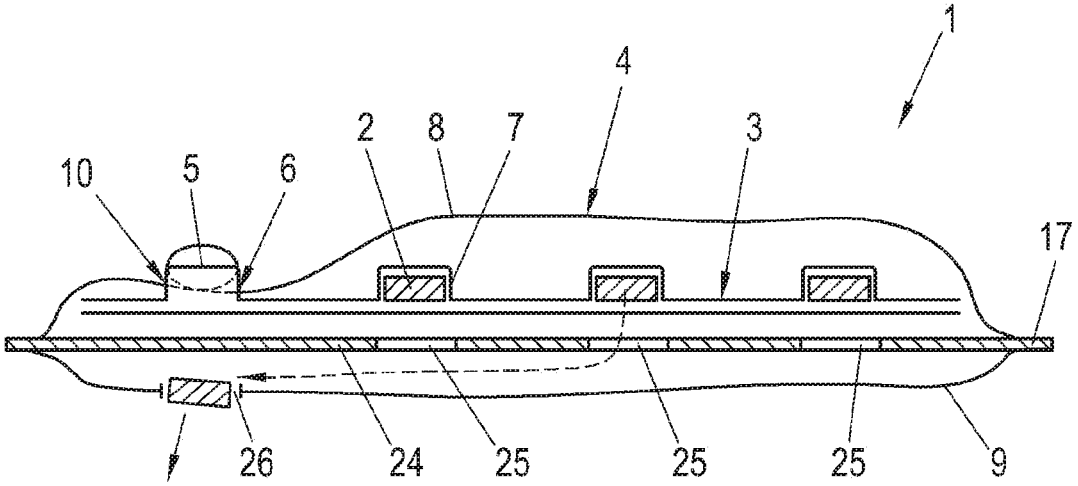
FIG. 10 is a sectional view of a packaging unit according to a further embodiment.

A further advantageous embodiment is described by way of example in FIG. 10. As in the embodiment represented in FIGS. 1 to 4, the blister packaging 3 according to FIG. 10 is secured in the outer packaging 4 in a removal position, in that a cup-like cavity acting as positioning element 5 is pressed through a weakened point 10 introduced into the first bag film 8 of the outer packaging 4, wherein the breaking of the weakened point 10 releases a receiving element 6 for the positioning element 5.

The outer packaging 4 is also provided with a locking element 24 that is connected to the first bag film 8 and the second bag film 9 at the seal region 17. The locking element 24 can, for example, be designed in the form of a hole plate made of plastic or cardboard, or in the form of a film, wherein the locking element 24 has a quantity of pass-through points 25 via which the products 2 can be "pressed through" if the blister packaging 3 is located in the removal position. The product 2 then falls into a region between the second bag film 9 and the locking element 24 and can there slide to a removal opening 26, where it can be removed.

The locking element 24 here need not be permanently attached to the outer packaging 4, but can also be movably arranged within the outer packaging 4, wherein it must always be ensured that the blister packaging 3 can be brought into a removal position defined in relation to locking element 24 and that the removal of the products 2 is not possible or is at least greatly hindered.

Figure 11:
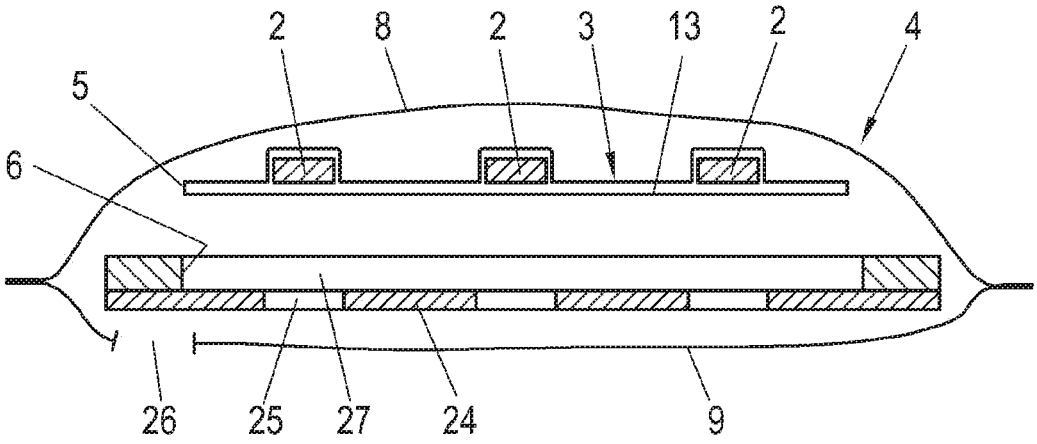
FIG. 11 is a sectional view of a further embodiment of the packaging unit according to the present teaching.

FIG. 11 shows an example of such an embodiment. While the locking element 24 is not connected to the outer packaging 4, it is, however, positioned in relation to this outer packaging 4 in such a way that the blister packaging 3 is arranged between the first bag film 8 and the locking element 24. The removal opening 26 is again arranged on the side of the second bag film 9.

In order to be able to remove a product 2 from the blister packaging 3, the latter must first be aligned with the pass-through points 25 of the locking element 24. For this purpose, the locking element 24 has a recess 27 on the side facing towards the first bag film 8 (and thus the blister packaging), whose edge corresponds to the contour of the back wall 13 of the blister packaging 3. The edge of the recess 27 thus forms a receiving element 6, into which the edge of the blister packaging 3 acting as positioning element 5 can be received in a positively locking manner. The blister packaging 3 and the locking element 24 must thus be put together in the manner of a puzzle before removal. Only in this position can a product 2 be pressed through the pass-through points 25 and removed via the removal opening 26.

The removal opening 26 of the embodiments in FIGS. 10 and 11 can additionally be secured via a reusable closure label, for example.

In a further embodiment that corresponds to a version of the embodiment from FIG. 10, the locking element 24 can also be integrated into the first bag film 8, for example. Instead of the pass-through points 25, the second bag film 9 may have expansion regions into which the products 2 can be pushed out of the blister packaging 3, wherein the expansion regions deform elastically and/or plastically in order to receive the respective product. After the product 2 is pressed out from the blister packaging 3, the former is still located inside the outer packaging 4 and can be brought to a removal opening 26 by shaking or moving.

In order to simplify finding the removal position for the user, the outer packaging in all embodiments can be designed as translucent or transparent or have see-through or transparent points that are used for orientation. Tips as to how products are to be removed can be printed directly on the outer packaging, possibly in the form of pictograms.

The embodiments described above can be freely combined in an appropriate manner, wherein all these combinations form a part of this disclosure.

The invention claimed is:

1. A packaging unit for one or a plurality of individual removable products, wherein the packaging unit has a blister packaging and a bag outer packaging, in which the blister packaging is enclosed, wherein the blister packaging is movably arranged within the outer packaging and can be brought into at least one removal position in which a removal of at least one of the products is possible, wherein the blister packaging has at least one positioning element and the outer packaging or a locking element arranged in or at the outer packaging has at least one receiving element for the positioning element, and wherein the positioning element arranged at the receiving element defines the removal position.

2. The packaging unit according to claim 1, wherein the blister packaging has a plurality of cup-like cavities, wherein at least one cup-like cavity of the blister packaging forms a positioning element.

3. The packaging unit according to claim 2, wherein at least one cup-like cavity that forms the positioning element is free from products.

4. The packaging unit according to claim 1, wherein at least one positioning element is formed by an extension of a molded part of the blister packaging.

5. The packaging unit according to claim 1, wherein at least one receiving element is defined by a molding in the outer packaging.

6. The packaging unit according to claim 5, wherein the molding is designed to receive a cup-like cavity of the blister packaging.

7. The packaging unit according to claim 5, wherein the molding forms a receiving recess in the edge region of the outer packaging.

8. The packaging unit according to claim 1, wherein the receiving element can be activated or deactivated via user intervention by a separating element that can be pierced by force and/or a foldable edge of the outer packaging and/or a removable safety element.

9. The packaging unit according to claim 1, wherein at least one receiving element is defined by a weak point in a first bag film and/or a second bag film of the outer packaging.

10. The packaging unit according to claim 9, wherein the weak point is arranged in such a manner that at least one cup-like cavity of the blister packaging breaks open the weak point when the blister packaging is moved into the removal position.

11. The packaging unit according to claim 10, wherein at least one weak point is located in one of the receiving recesses arranged on an edge region of the outer packaging, wherein the breaking-open of the weak point requires moving the blister packaging along a rear-wall level of the blister packaging.

12. The packaging unit according to claim 1, wherein, in the removal position, at least one product chamber of the blister packaging is arranged with the product delivery side above a break-through point provided in the outer packaging.

13. The packaging unit according to claim 1, wherein a plurality of different removal positions is provided in the outer packaging.

14. The packaging unit according to claim 1, wherein a locking element, which has at least one receiving element for the positioning element, is integrated in the outer packaging, is arranged within it or is connected thereto.

15. The packaging unit according to claim 1, wherein the at least one of the products comprises a tablet.

16. A packaging for individual removable products, comprising:

a blister packaging having a film wall and a positioning element;

a bag outer packaging having a breakthrough point and a locking element;

the blister packaging movably arranged within the bag outer packaging;

a removal position defined when the positioning element is aligned with the locking element, such that removal of at least one of the products is possible through the film wall and the breakthrough point.

17. The packaging of claim 16, wherein:

the positioning element comprises a molded part of the blister packaging; and the locking element comprises a weak point in the bag outer packaging.

18. The packaging of claim 16, wherein the locking element can be activated by user intervention.

19. The packaging of claim 16, wherein a plurality of removal positions is provided.

20. The packaging of claim 16, wherein the individual removable products comprise tablets.

* * * * *